US006763801B1

(12) United States Patent
Decuir, Jr.

(10) Patent No.: US 6,763,801 B1
(45) Date of Patent: Jul. 20, 2004

(54) INTERNAL COMBUSTION ENGINE UTILIZING INTERNAL BOOST

(76) Inventor: Julian A. Decuir, Jr., 25920 Fran Lou Dr., Moreno Valley, CA (US) 92388

( * ) Notice: Subject to any disclaimer, the term of this patent is extended or adjusted under 35 U.S.C. 154(b) by 0 days.

(21) Appl. No.: 08/165,002

(22) Filed: Dec. 10, 1993

Related U.S. Application Data

(63) Continuation-in-part of application No. 08/089,052, filed on Jul. 7, 1993, now abandoned, which is a continuation of application No. 07/982,205, filed on Nov. 25, 1992, now abandoned, which is a continuation of application No. 07/830,959, filed on Feb. 4, 1992, now abandoned, which is a continuation of application No. 07/634,953, filed on Dec. 28, 1990, now abandoned, which is a continuation of application No. 07/496,987, filed on Mar. 21, 1990, now abandoned.

(51) Int. Cl.[7] ..... F02B 33/04
(52) U.S. Cl. ..... 123/317
(58) Field of Search ..... 123/317, 318

(56) References Cited

U.S. PATENT DOCUMENTS

| | | | | |
|---|---|---|---|---|
| 1,178,915 A | | 4/1916 | Guthrie | |
| 1,351,763 A | | 9/1920 | Kirkham | |
| 1,597,706 A | | 8/1926 | Aldous | |
| 1,803,326 A | * | 5/1931 | Gernandt | 123/317 |
| 1,915,977 A | | 6/1933 | Brush | |
| 1,972,752 A | | 9/1934 | Balough | |
| RE20,597 E | | 12/1937 | Jackson | |
| 2,782,774 A | | 2/1957 | Jasper | |
| 3,003,485 A | | 10/1961 | Chard | |
| 3,100,028 A | | 8/1963 | Bootti et al. | |
| 3,101,129 A | | 8/1963 | Hulten | |
| 3,106,263 A | | 10/1963 | McKellar | |
| 3,613,646 A | * | 10/1971 | Hisada | 123/317 |
| 3,672,172 A | * | 6/1972 | Hammond | 123/317 |
| 4,553,508 A | | 11/1985 | Stinebaugh | 123/332 |
| 4,558,671 A | | 12/1985 | Stinebaugh | 123/317 |
| 4,708,107 A | | 11/1987 | Stinebaugh | 123/317 |
| 4,856,486 A | | 8/1989 | Mori | 123/572 |
| 5,347,967 A | * | 9/1994 | Todero et al. | 123/317 |

* cited by examiner

*Primary Examiner*—Andrew M. Dolinar
(74) *Attorney, Agent, or Firm*—Stetina Brunda Garred & Brucker

(57) ABSTRACT

An internal combustion engine is provided wherein the crankcase is sealed from the oil pan to provide an airtight compression chamber wherein the air is compressed by action of the pistons. Air is withdrawn from the atmosphere through one-way valves on the engine block. The compressed air is then passed from the compression chamber into, optionally, a compressed air storage means where it is regulated through a valve for mixture with the air-fuel mixture from the carbureting means, thereby providing a boost in the air-fuel charge entering the combustion chambers. Lubricating modifications are also provided to lubricate the crankshaft and camshaft bearings located within the compression chamber.

11 Claims, 5 Drawing Sheets

INTERNAL COMBUSTION ENGINE UTILIZING INTERNAL BOOST

CROSS REFERENCE TO RELATED APPLICATIONS

To the best of Applicant's knowledge, the present application is a continuation-in-part of U.S. patent application Ser. No. 08/089,052, filed Jul. 7, 1993, entitled Internal Combustion Engine Utilizing Internal Boost, now abandoned; which was a continuation of U.S. patent application Ser. No. 07/982,205, filed Nov. 25, 1992, entitled Internal Combustion Engine Utilizing Internal Boost, now abandoned; which was a continuation of U.S. patent application Ser. No. 07/830,959 filed Feb. 4, 1992, entitled Internal Combustion Engine Utilizing Internal Boost, now abandoned, which was a continuation of U.S. patent application Ser. No. 07/634,953, filed on Dec. 28, 1990, entitled Internal Combustion Engine Utilizing Internal Boost, now abandoned, which was a continuation of U.S. patent application Ser. No. 07/496,987, filed on Mar. 21, 1990, entitled Internal Combustion Engine Utilizing Internal Boost, now abandoned.

The present invention relates to an internal combustion engine in which there is a compression boost for the fuel-air mixture directed to the combustion chamber of the cylinder. According to the invention, the internal volume of engine block, including the crank case, serves as a compression chamber in which air is compressed by the reciprocating action of the pistons.

BACKGROUND OF THE INVENTION

There is an ongoing need for increasing the power from small displacement internal combustion engines. This can be readily accomplished, for example, by turbocharging or supercharging, however, the problem is complicated by the changing requirements for pollution control of the exhaust from such engines.

There have been disclosed in the prior art, internal combustion piston-type engines in which the fuel-air mixture from a carburetor is passed into the crankcase of the engine where it is compressed. The compressed fuel-air charge is then conducted via manifolds into the combustion chambers.

Such systems, while effective in increasing the power of the engine by compressing the fuel-air mixture, do not appear to solve the problem of reducing pollution control, since passing a fuel-air mixture through the engine block mixes it with oil mist which results from the lubrication of the crankshaft journals, oil pan, etc. Introducing this oil into the combustion chamber to be burned adds to the pollution of the exhaust gases.

Therefore, there is a need in the art to provide an internal combustion engine in which power can be enhanced by compression of the charge entering the combustion chamber, yet still meeting the increasingly stringent pollution control standards. Furthermore, there is a need to accomplish this in a technically simple manner, preferably by avoiding use of expensive catalysts (which must be replaced) which use precious metals, and avoiding delicate electronic computer-controlled equipment whose longevity is questionable in the stringent environment of an internal combustion engine.

SUMMARY OF THE INVENTION

In accordance with the present invention, and as a principal embodiment thereof, the present invention provides a four-stroke reciprocating piston-internal combustion engine comprising a cylinder block having a plurality of cylinders, where each of the cylinders accommodates a piston slidably received therewithin. One side of each of the pistons defines a combustion chamber and the other side, to which a connecting rod is affixed, serves to compress the volume of air within the crankcase. Each combustion chamber may be in communication in a conventionally timed manner through a first valve means with a source of a fuel-air mixture (such as a carburetor or fuel injection system) to admit this mixture into the chamber, and further in communication in a timed manner through a second valve means with an exit port to withdraw exhaust gases from the combustion chamber. The connecting rods connect the pistons to the crankshaft which is enclosed by the engine block or combination of an engine block and crankcase which is sealed, usually to the bottom of the engine block. The engine block also accommodates journal supporting means for accommodating the crankshaft and crankshaft bearings. The internal portion of the block may also have internal walls, also providing additional journal-supporting means for the crankshaft and crankshaft bearings. Depending on the configuration of the engine, the block may also accommodate journal-supporting means for camshafts and camshaft bearings. The bottom of the crankcase may, but does not necessarily have to include an oil pan at its lowermost portion. An air and fuel intake system is coupled to the cylinders, usually by a manifold system leading from one or more carburetors or a fuel injection system. The present invention provides an improvement to such an internal combustion engine by providing sealing plates to substantially form an air-tight seal between the oil pan, if present, and the interior volume of the engine to thereby define a compression chamber comprising the interior of the crankcase and the volume within the engine block in communication with the crankcase and bottom of the pistons. The primary purpose of the sealing plate(s) is to prevent oil in the oil pan from mixing with the interior volume of the crankcase (which is a compression chamber) so as not to contaminate the air passing through the crankcase with oil. No fuel or fuel vapors are introduced into this interior volume. To utilize the crankcase (sealed from the oil pan) as a compression chamber, at least one one-way valve means is adapted on the engine block in communication with the compression chamber which allows air to be admitted from the atmosphere into the compression chamber. Such a one-way valve means is preferably a reed valve. The desired pressure to be attained within the compression chamber can be selected by adjusting the pressure on the closure of the reed valve.

In the preferred embodiment shown in the attached figures, there is shown a flat horizontally opposed four cylinder engine in which there are two banks of two cylinders. The two cylinders (one on each of the banks) which directly oppose each other simultaneously are on a downward stroke thereby compressing the air within the chamber. As shown in the preferred embodiment, there are two distinct compression chambers, so that the four cylinders do not counteract each other, i.e., when two opposing cylinders are on their downward (inward) stroke one volume of air is compressed which is separate from the volume of air which is compressed when the other two opposing cylinders are on their downward stroke. The separation between the two volumes of air is accomplished by an internal wall extending from the interior of the block of the engine which also provides additional journal-supporting means for the crankshaft.

After compression of the air in the compression chamber (which does not contain any fuel or oil) a one-way valve means adapted on the block is provided which releases the compressed air from the compression chamber toward the air and fuel intake system. Preferably the compressed air is first retained in a compression reservoir from which the air can be regulated through a valve means such as a butterfly valve and directed into the intake manifolds or other equivalent means of introducing the fuel and air into the combustion chambers.

When adapted to a conventional four-stroke internal combustion engine, by providing a sealing plate(s) between the oil pan and crank case, the engine must further be provided with a method for lubricating the crankshaft journals and camshaft journals if the camshafts are disposed within the compression chamber. This lubrication, however, must be provided in a way so as not to allow oil droplets or mist to be mixed with the air in the compression chamber. Therefore, lubricating channels are provided according to the present invention in the journal-supporting means for the crankshaft and camshaft (if necessary). Liquid lubricant is flowed from an oil pump means through the lubricating channels and then directed through a channel to an oil pan located below the sealing plate. In this manner the lubricating fluid which lubricates the journals does not come in contact with the compression chamber, but still provides adequate lubrication for the journals.

It is contemplated that although the above method for lubricating the crankshaft and camshaft journals will probably not allow contact of the oil with the compression chamber, during high RPM operation of the engine and particularly after there is much engine wear, there is a possibility of seepage of small amounts of oil into the compression chamber, such as by ring wear around the pistons. Therefore to continue to maintain the low pollution emission from the engine, a filtering means may be provided adjacent to the second valve means (through which the compressed air exits the compression chamber) to filter any solid or liquid particulate matter which may be present in the compression chamber.

To circulate the lubricating oil within the engine described in the preferred embodiment, oil is withdrawn through a line directly from the oil pan through the conventional oil pump which is adapted to the engine and recirculated (after passage through an oil cooler, if present) directly to an input line to the lubricating channels for the crankshaft and camshaft journals.

The above description of the invention may be provided to include the described features during the original manufacture of the engine. However, it is further contemplated that the above modifications may be made to retrofit existing engines.

DESCRIPTION OF THE PREFERRED EMBODIMENTS

Figure 1A:
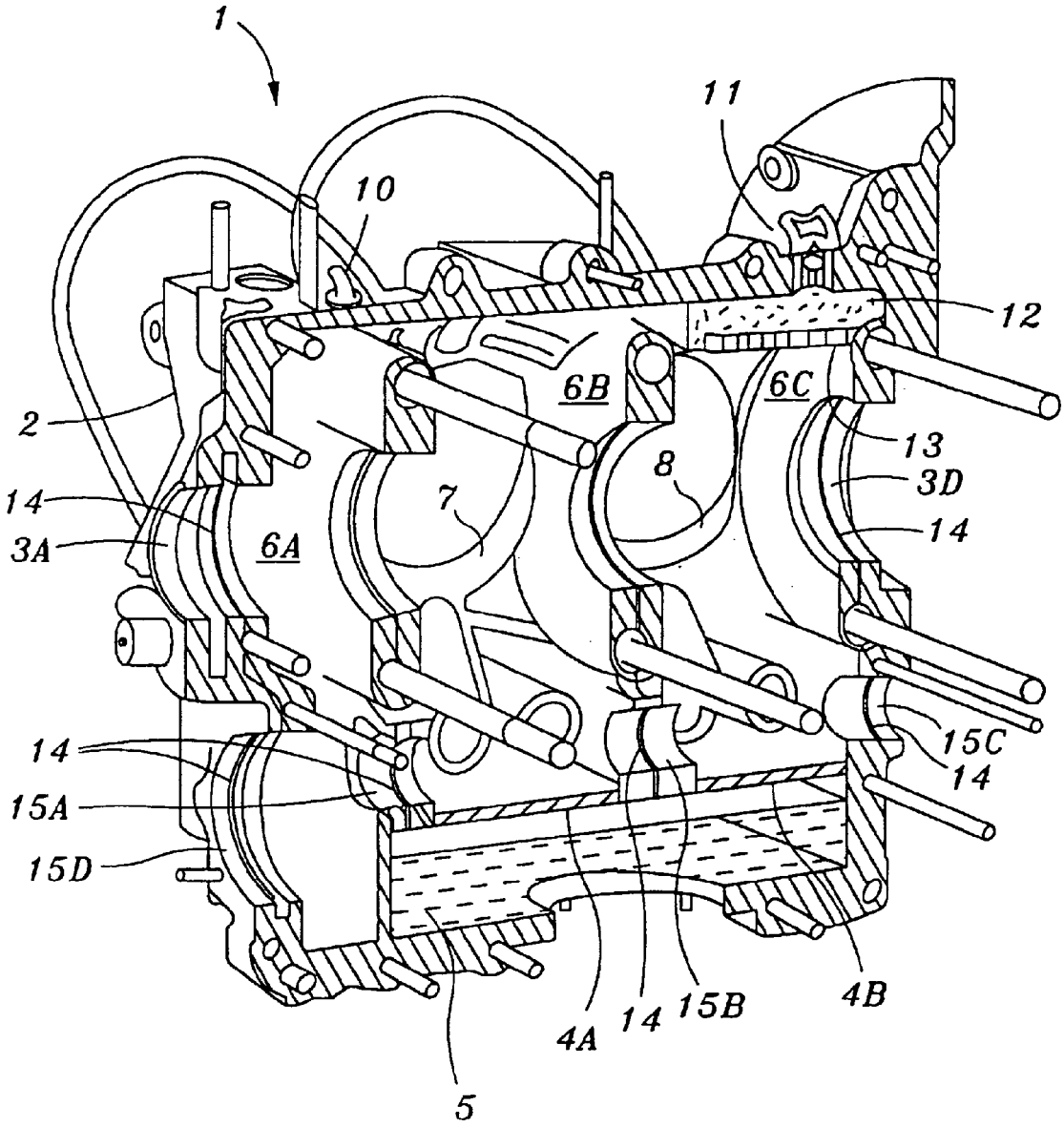
FIG. 1A is a cross-sectional view of a four-cylinder horizontally-opposed engine showing a two-cylinder bank thereof.

As shown in FIG. 1A, there is shown an engine 1 in cross-sectional view showing one-half of the engine block 2 of a four-cylinder four-stroke horizontally opposed engine having two banks of horizontally opposed cylinders. In this instance, the half engine block is formed essentially of a single piece without a separate crankcase bolted thereto from beneath. In this configuration it can be seen that plates 4*a* and 4*b* completely separate the oil reservoir 5 from the remaining interior volume of the engine. If there is no internal oil reservoir, the plates 4*a* and 4*b* still isolate the compression compartments. There are two compression compartments within the interior of the engine, the first defined by plate 4*a,* interior journal supporting wall 6*a,* internal journal supporting wall 6*b* and the bottom surfaces of the piston (not shown) which slidably fits into the bore 7 and the corresponding opposing piston (not shown) located in the other half of the engine block (not shown). The second compression chamber is defined by the bottom wall 4*b* and internal journal-supporting wall 6*b,* 6*c* and the bottom of the piston (not shown) which slidably fits into the cylinder bore 8 and the bottom of opposing piston in the other half of the engine block (not shown). A reed valve 10 is provided in the engine block 2 as an intake for air directly from the atmosphere into one of the compression chambers. The exit reed valve for that chamber is not shown, since it is located on the other half of the block. An exit reed valve 11 is provided for directing the compressed air within a compression chamber into the air-fuel mixture, or alternatively into a compressed air storage chamber from which it can be monitored from a valve means into the air-fuel mixture. The intake reed valve for that chamber is not shown. To minimize introduction of particulate and oil droplets into the air-fuel mixture, a filtering means 12 such as a metallic gauze material is provided in a compartment 13.

As shown, the crankshaft sleeves 3*a,* 3*b,* 3*c* and 3*d* are equipped with lubricating grooves 14 which interconnect with the camshaft sleeves 15*a, b, c* and *d* and eventually drain into the oil pan 5. The lubrication system will be shown in more detail in FIGS. 1B and 2A below.

Figure 1B:
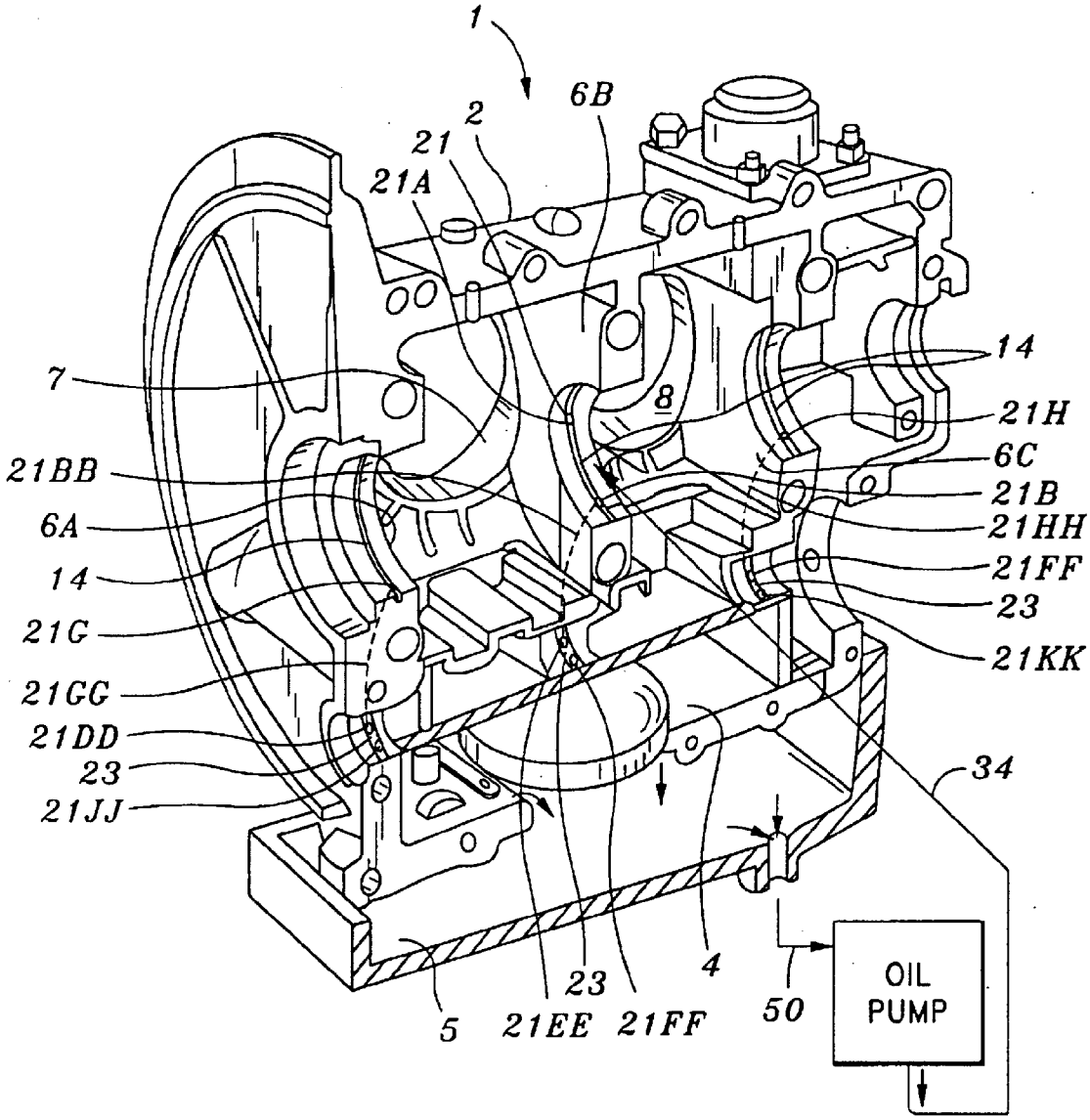
FIG. 1B is a cross section view of a two-cylinder bank of a four cylinder engine, showing detail of oil flow.

Referring to FIG. 1B, there is shown another two cylinder bank of a four-cylinder horizontally opposed engine. The reed valves corresponding to 10 and 11 in FIG. 1A are not shown in order to illustrate detail of the oil flow. The main oil feed line 34 is shown schematically as feeding oil through passage 21 which terminates at port 21*a* to lubricate a main crankshaft journal. Oil from the journal is drained through port 21*b,* through passage 21*bb* and port 21*ee* on a camshaft journal. From the camshaft journal, oil drains through port 21*ff* into the oil pan 5. To lubricate the crankshaft end journals, oil passes from the central journal to the end journals as described in FIG. 2B. At each crankshaft end journal oil passes out of the crankshaft bearing (not shown) and drains through port 21*g* (21*h*), passage 21*gg* (21*hh*) and port 21*dd* (21*ff*) to lubricate the camshaft end journals. Oil then drains through port 21*jj* (21*kk*) to collect in oil pan 5. Oil is recirculated through drain line 50 to the oil pump.

Figure 2A:
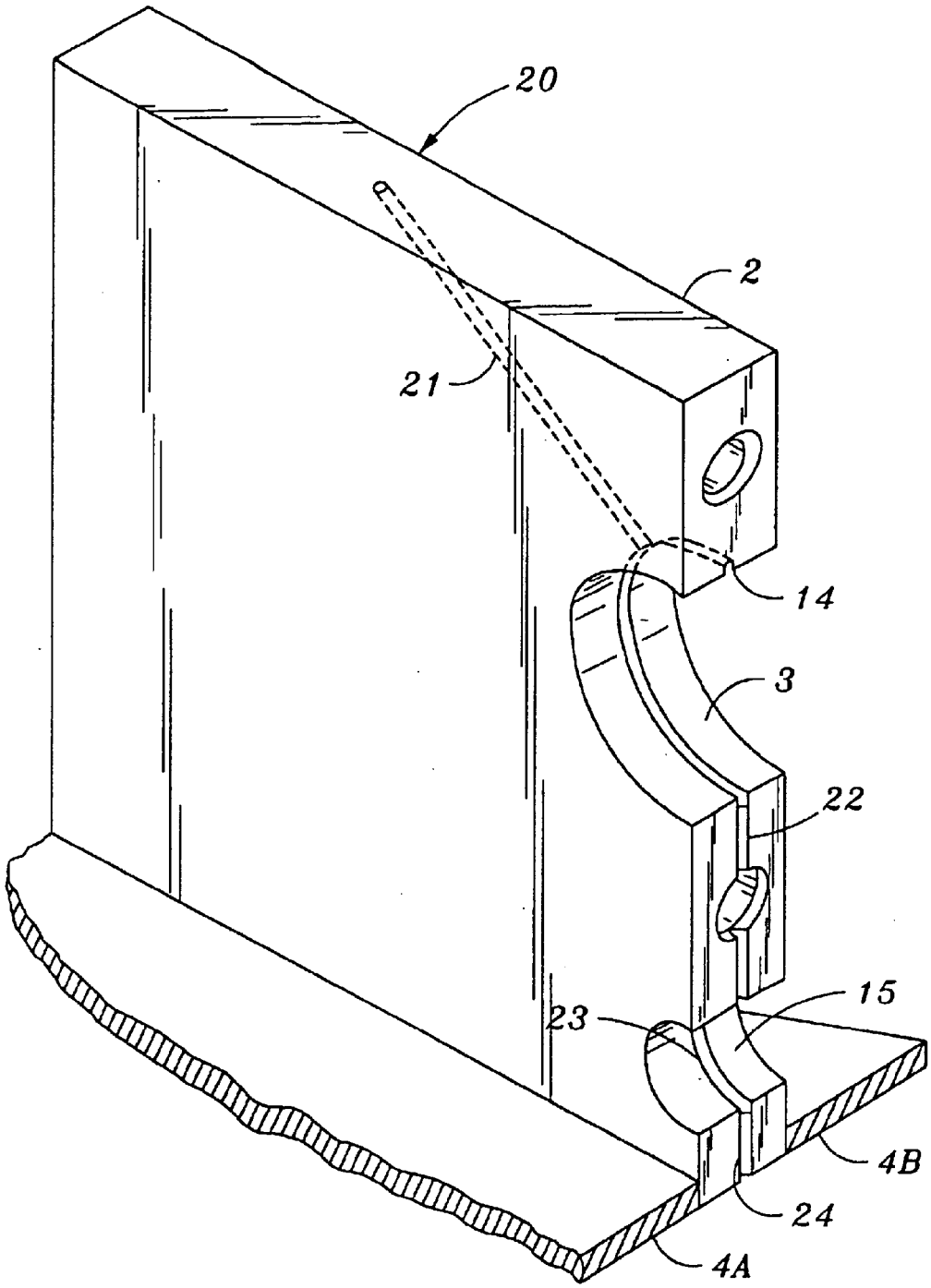
FIG. 2A is a detailed view of the crankshaft and camshaft journals in the engine block of the engine shown in FIG. 1A showing lubricating grooves for those journals.

Referring to FIG. 2A, there is shown a portion of the engine block 2 which bears a crankshaft sleeve 3 and a camshaft sleeve 15. Portions of the plates 4*a* and 4*b* which separate the compression chamber from the oil pan are also shown. To lubricate the sleeves 3 and 15 (which will accommodate the respective crankshaft bearings and camshaft bearings (not shown) oil is introduced from the oil pump (not shown) through an upper lubricating orifice 20 which interconnects through a hole 21 to communicate with lubricating groove 14. Groove 14 circumferentially provides oil to the sleeve 3 and excess oil drains through the groove 22 to interconnect with a circumferential lubricating groove 23 which provides lubrication to the camshaft bearing (not shown). Excess oil is then drained from the groove 24 to the oil pan below.

Figure 2B:
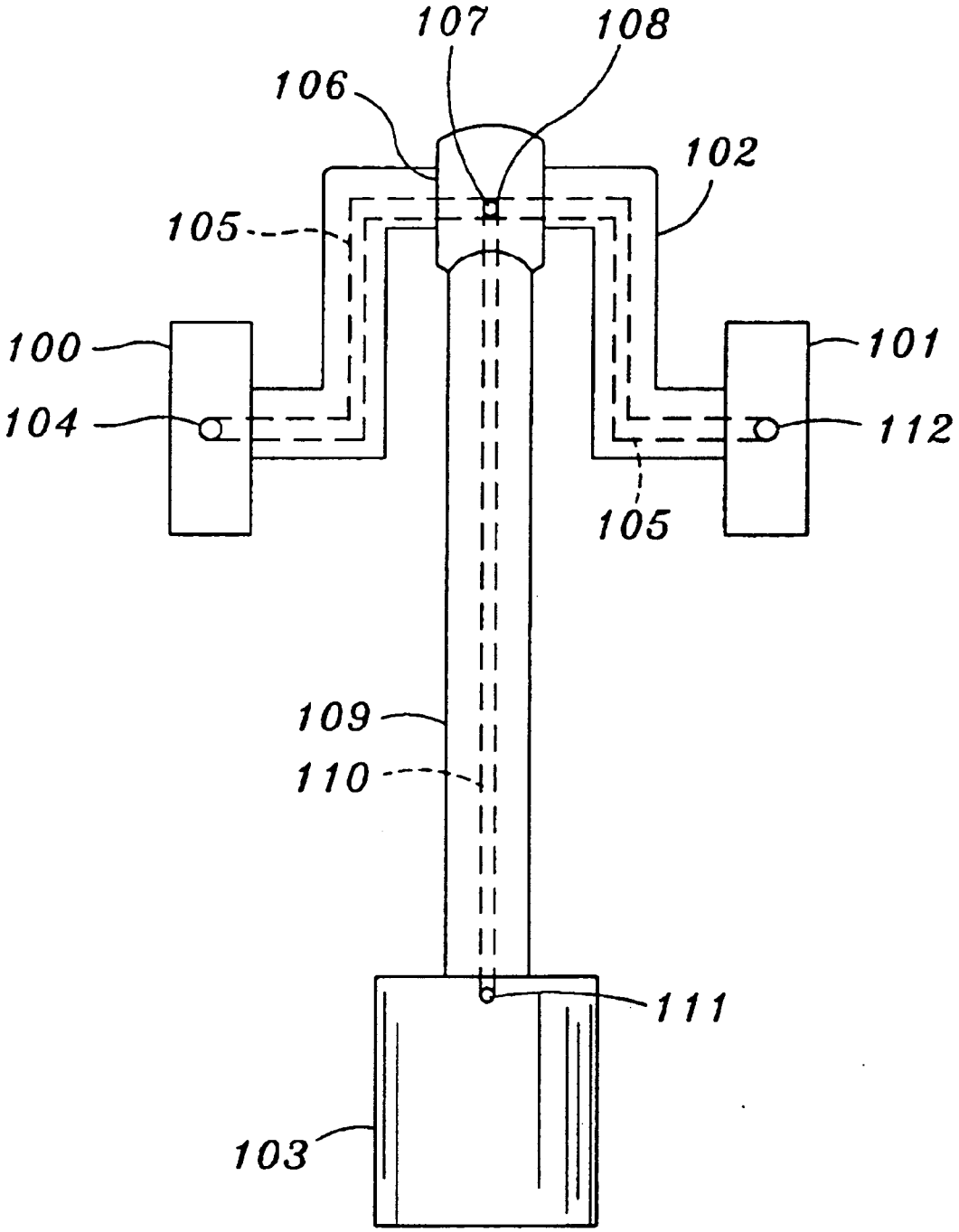
FIG. 2B is a detailed view of the lubrication system for the connecting rod journal and crankpin of pistons in engines shown in FIGS. 1A and 1B.

Referring to FIG. 2B, there are shown the center main bearing and one of the end bearings of crankshaft 102 for the engines shown in FIG. 1A or 1B. Only one piston 103 is shown. Bearing 100 communicates with groove 14 (FIG. 2A) in the main crankshaft journal through port 104, which is the entry for passage 105, terminating at the connecting rod journal 106 at port 107. A port 108 (shown overlapping port 107) in the connecting rod is the entry for passage 110 leading to the wristpin journal (not shown) and terminating at port 111. Passage 105 from the main bearing 100 continues to the other end journal 101 and terminates at port 112. By this route, oil is circulated to each of the crankshaft journals and bearings, areas of contact between the connecting rods and crankpins, and contact points of the connecting rods and piston wristpins without exposure of oil to the interior chamber in which air is compressed.

Figure 3A:
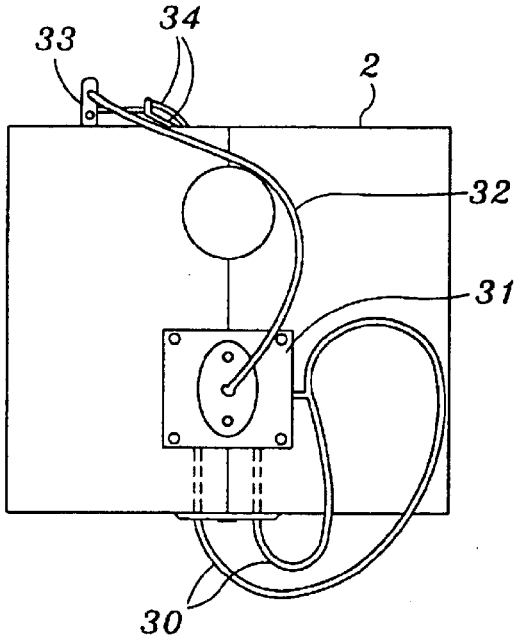
FIG. 3A is a front schematic view of the engine block of FIG. 1 showing the oil lines modified for directing oil from the oil sump through the oil pump to the camshaft and crankshaft journals.

Referring to FIG. 3A there is shown a schematic front view schematically of the engine block of FIG. 1A depicting the interconnection of oil lines for rerouting the oil from the oil pan. Oil is taken from the oil reservoir in the oil pan through lines 30 and introduced into the oil pump 31. From the oil pump the oil is pumped under pressure via lines 32 to an oil cooler 33. It will be realized that an oil cooler is an optional feature since many conventional engines do not require a separate cooling radiator for the oil. From the oil cooler the oil is passed through main oil pressure feed main lines 34, connected to the oil ports 20 (referring to FIG. 2A).

Figure 3B:
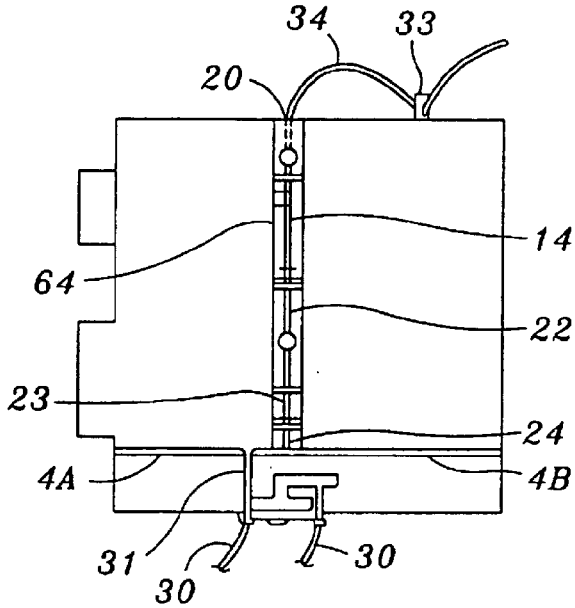
FIG. 3B is a side view of the lubricating system showing the lubricating channels for the crankshaft and camshaft journals in an internal wall of an engine shown in FIG. 1A.

FIG. 3B is a partial cutaway side view of an interior journal support wall such as 6*a* or 6*b* shown in FIG. 1A. Oil from the oil cooler 33 is introduced via main oil feedline 34 into port 20 which then feeds oil into the lubricating grooves 14, 22, 23 and 24 as described in connection with FIG. 2A. Oil is then withdrawn via lines 30 from the oil reservoir back into the oil pump. As shown, one of the tubes 30 may be connected to a collector 31 to drain any oil which may incidentally collect above the plates 4*a* and 4*b*.

Figure 4:
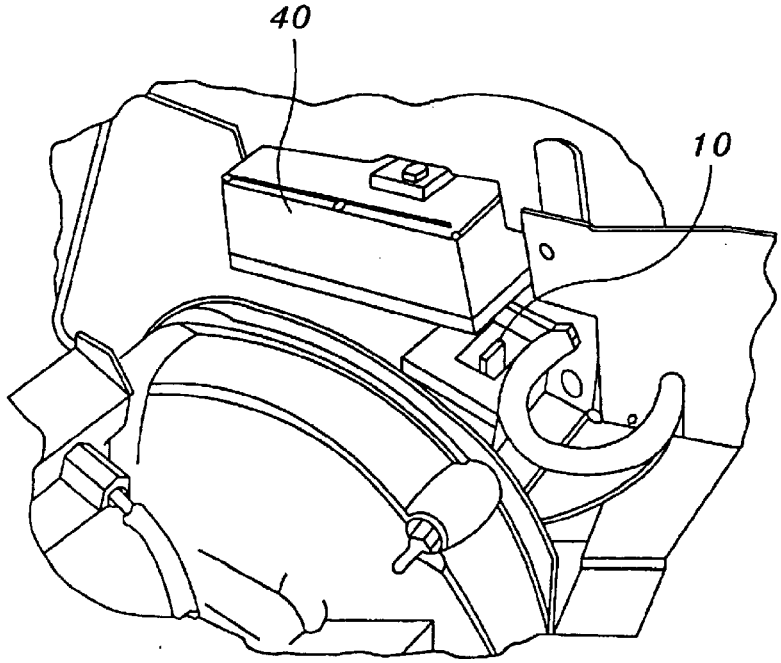
FIG. 4 is an exterior view of the rear of the engine shown in FIG. 1A showing the location of a reed valve open to the atmosphere and a compression storage chamber for retaining the compressed air from the compression chamber within the engine block.

Referring to FIG. 4 there is shown a partial cutaway perspective view of a portion of an engine showing the location of intake reed valve 10 which draws air directly from the atmosphere into the compression chamber and a compressed air collection box 40 into which compressed air entering from reed valve 11 (referring to FIG. 1A) may be stored. The compressed air in 40 may then be regulated through a conventional valve means such as a butterfly valve (not shown) into the intake manifold of the engine.

EXAMPLE 1

A four-cylinder opposed four-stroke 1.6 liter carburetted engine (1963 VW) modified in accordance with the invention for internal boost was tested for HC, CO, O2, CO2 emissions using standard equipment and procedures for automobile emissions testing.

The results were 182 ppm hydrocarbons, 0.12% CO, 13.7% CO2 and 1.5% O2 at idle. The California State Emission Standards (for the years 1980–1999) are 220 ppm max. hydrocarbons, 0.05–1.2% CO, 7.0% max. O2, and 7.4–16.0% CO2. In 1963, when this engine was produced, the emission compliance was 1000 ppm max. HC, 4.0–8.0% CO, 7.0% max. O2, and 7.4–16.0% CO2. Thus, the modified engine meets the more stringent emission standards.

EXAMPLE 2

A four-cylinder engine (VW 1.6 liter, opposed) is measured at peak horsepower of 53 HP. Modified in accordance with the present invention the engine has a peak of about 70 HP.

While I have shown and described the preferred embodiment of my invention, it will be apparent to those skilled in the art that many changes and modifications may be made without departing from my invention in its broader aspects. In particular, it will be readily apparent to those of ordinary skill in the art that the compression of air within the crankcase by the downward strokes of pistons in a four stroke engine can be readily applied to other configurations, including, but not limited to, in-line four, five and six cylinder engines, vee-six, eight, ten and twelve cylinder engines, and the like. I therefore intend the appended claims to cover all such changes and modifications as fall within the true spirit and scope of my invention.

What is claimed is:

1. In a four-stroke reciprocating piston-type internal combustion engine comprising:

a cylinder block having a plurality of cylinders, each of said cylinders accommodating a piston slidably received therewithin to define a combustion chamber, each of said combustion chambers communicating in a tied manner through a first valve means with a source of fuel-air mixture to admit said mixture into said combustion chamber;

and each of said combustion chambers further communicating in a timed manner through a second valve means with an exit port to withdraw exhaust gases from said combustion chamber;

connecting rods connecting said pistons to a crankshaft;

a crankcase defined within said cylinder block accommodating said crankshaft, said crankcase having journal supporting means;

wherein each of said journal supporting means accommodates means for distributing liquid lubrication to bearings received by said journal supporting means;

an oil reservoir in the interior of said block;

an air and fuel intake system coupled to said cylinders;

the improvement comprising sealing means providing a substantially airtight seal separating said oil reservoir from the remaining interior volume of said engine, thereby defining at least one compression chamber in the interior volume of said block in communication with the lower surface of at least one of said pistons;

a first one-way valve means adapted on said block in communication with said compression chamber for admitting air from the atmosphere into said compression chamber by action of said piston;

a second one-way valve means adapted on said block for releasing air from said compression chamber to be directed to said air and fuel intake system.

2. An engine according to claim 1 further comprising a lubricating channel to at least one of said journal supporting means through which liquid lubricant is flowed without communicating with said compression chamber.

3. An engine according to claim 1 further comprising camshaft journal supporting means and lubricating channels through which liquid lubricant is flowed to said camshaft journal supporting means without communicating with said compression chamber.

4. An engine according to claim 1 wherein said first and second one-way valve means comprise reed valves.

5. An engine according to claim 3 further comprising compressed air storage means in which compressed air passing through said second valve means is stored prior to mixture with said air and fuel intake system.

6. An engine according to claim 5 wherein said compressed air from said compressed air storage means is regulated by valve means directing said compressed air into said air and fuel intake system.

7. An engine according to claim 1 further comprising filter means for trapping solid or liquid particulate prior to release of compressed air from said compression chamber through said second valve means.

8. An engine according to claim 2 further comprising circulating and pump means for circulating liquid lubricant from said oil reservoir and pumping said lubricant through said lubricating channels.

9. An engine according to claim 3 further comprising circulating and pump means for circulating liquid lubricant from said oil reservoir and pumping said lubricant through said lubricating channels.

10. An engine according to claim 1 further comprising lubricating channels from said journal supporting means through said crankshaft through which liquid lubricant is flowed to lubricate the area of contact between said crankshaft and each of said connecting rods.

11. An engine according to claim 10 further comprising lubricating channels from each of said areas of contact through each respective connecting rod to the connecting point thereof to a piston.

* * * * *